US005154474A

United States Patent [19]

Desanta

[11] Patent Number: 5,154,474

[45] Date of Patent: Oct. 13, 1992

[54] STACKABLE LINE CHAIR

[76] Inventor: Simon Desanta, Hollen, Im Lohden, W-4830 Güterslon 12, Fed. Rep. of Germany

[21] Appl. No.: 749,535

[22] Filed: Aug. 26, 1991

[30] Foreign Application Priority Data

Oct. 11, 1990 [DE] Fed. Rep. of Germany ..... 4032278

[51] Int. Cl.[5] ..... A47C 3/04

[52] U.S. Cl. ..... 297/239; 297/248; 297/447

[58] Field of Search ..... 297/239, 248, 257, 445, 297/447

[56] References Cited

U.S. PATENT DOCUMENTS

| | | | |
|---|---|---|---|
| 2,572,591 | 10/1951 | Booth | 297/447 |
| 2,709,119 | 5/1955 | Chapman et al. | 297/239 X |
| 3,053,493 | 9/1962 | Stafford | 297/239 |
| 3,141,699 | 7/1964 | Stafford | 297/239 |
| 3,259,431 | 7/1966 | Gale | 297/445 X |

FOREIGN PATENT DOCUMENTS

| | | | |
|---|---|---|---|
| 8911803 | 1/1990 | Fed. Rep. of Germany . | |
| 991561 | 10/1951 | France . | |
| 1558986 | 1/1969 | France . | |
| 1204613 | 9/1970 | United Kingdom | 297/248 |

*Primary Examiner*—Peter R. Brown
*Attorney, Agent, or Firm*—Spencer, Frank & Schneider

[57] ABSTRACT

A stackable line chair includes four legs which stand on the floor and support a seating plate (14,16,18,20). The legs are arranged in pairs in respective planes on both sides of the chair, and diverge obliquely in the downward direction. They are offset on one side of the chair in comparison with the legs of the other side by one leg thickness relatively to the seating plate (10).

8 Claims, 2 Drawing Sheets

STACKABLE LINE CHAIR

BACKGROUND OF THE INVENTION

The invention relates to a stackable line chair with four legs which stand on the floor and which support a seating plate, the legs being arranged in pairs in respective planes on both sides of the chair and diverging obliquely in the downward direction.

Different embodiments of stackable chairs having lateral pairs of legs arranged in one plane which are obliquely diverging downwards to the front and the rear are well known. When stacked, the lateral pairs of legs can be pushed more or less far over the corresponding pairs of legs of the next chair below. This leads to a relatively low stacking hight, even if a great number of chairs are stacked. Apart therefrom, also stackable line chairs are known providing the additional object to obtain a possible close compound arrangement in the lateral direction or in the direction of the line to be formed, so that it is common also here to form the lateral pairs of legs such that the lateral leg pairs of two adjacent chairs can be pushed one into the other. Examples of these known solutions may be found in German Auslegeschrift (examined, published patent application) 1,285,137 and U.S. Pat. No. 3,827,749.

The legs on both sides of the chair according to German Auslegeschrift 1,285,137 are positioned at different distances, so that the left pair of legs can be pushed between the right pair of legs of the adjacent chair, respectively, and vice versa. Since the distance between the lateral legs of one side is about two leg diameters greater than on the other side, the result is a clearly visible asymmetry of the chair and thus, an appearance which is undesirable at least if the chair is used singly.

The chair of U.S. Pat. No. 3,828,749 does not only have the difference in respect of the distance between the lateral legs, which is two leg diameters also here, but both lateral leg pairs each are part of an U-shaped shackle positioned laterally of the seating plate, which is significantly higher on one side than on the other, so that the shackles may be stacked one upon another when forming a line of chairs, so that, as a result, the assymetry is even more visible here.

SUMMARY OF THE INVENTION

It is therefore the object of the invention to produce a stackeable line chair allowing a lateral joining of the lateral leg pairs of adjacent chairs without the necessity of having to accept a significant asymmetry in respect of the vertical center plane of the chair determined by the user's line of vision.

According to the invention this object is achieved by a chair of the above kind in that the legs of one side of the chair are offset by one leg thickness relative to the seating plate as compared with the legs on the other side.

Thus, both legs of one side are standing either more to the rear or more to the front by one leg thickness than the legs of the other leg pair, with the leg pairs however giving a totally identical appearance. This kind of asymmetry of the chair is optically hardly visible. Thus, this chair may also readily be used as an individual chair or a normal stacking chair.

In the case of traditional chairs of this kind either the lateral leg pairs are legs of U-shaped shackle, the center part of which is arranged along the side of the chair, as it is the case with U.S. Pat. No. 3,827,749, or the front and rear leg pairs form a corresponding U-shaped shackle, the center part of which is running in a transverse direction below the seating plate from one side to the other (German Auslegeschrift 1,285,137). This means that both shackles have to be connected sufficiently stable by two connecting rods. According to the U.S. Patent, these connecting rods are running in a transverse direction of the chair, and according to the German Auslegeschrift on both sides of the seating plate in the longitudinal direction thereof. The use of these connecting rods not only means increased material and labour consumption, but also leads to a statically relatively unfavourable more or less point-like connection between shackles and connecting rods.

According to a preferred embodiment of the invention, the front legs are running obliquely below the seating plate and join on the rear side until they are connected behind the seating plate to a raised up holder for a backrest, whereas both rear leg pairs are parts of a continuous shackle positioned below the seating plate and arched as a bow to the front, thus crossing both front legs which are running to the rear side. Thereby, a triangular compound arrangement is formed between both front legs obliquely running to the rear side and meeting in the middle and the center part of the shackle of the rear legs.

DESCRIPTION OF THE PREFERRED EMBODIMENT

Figure 1:
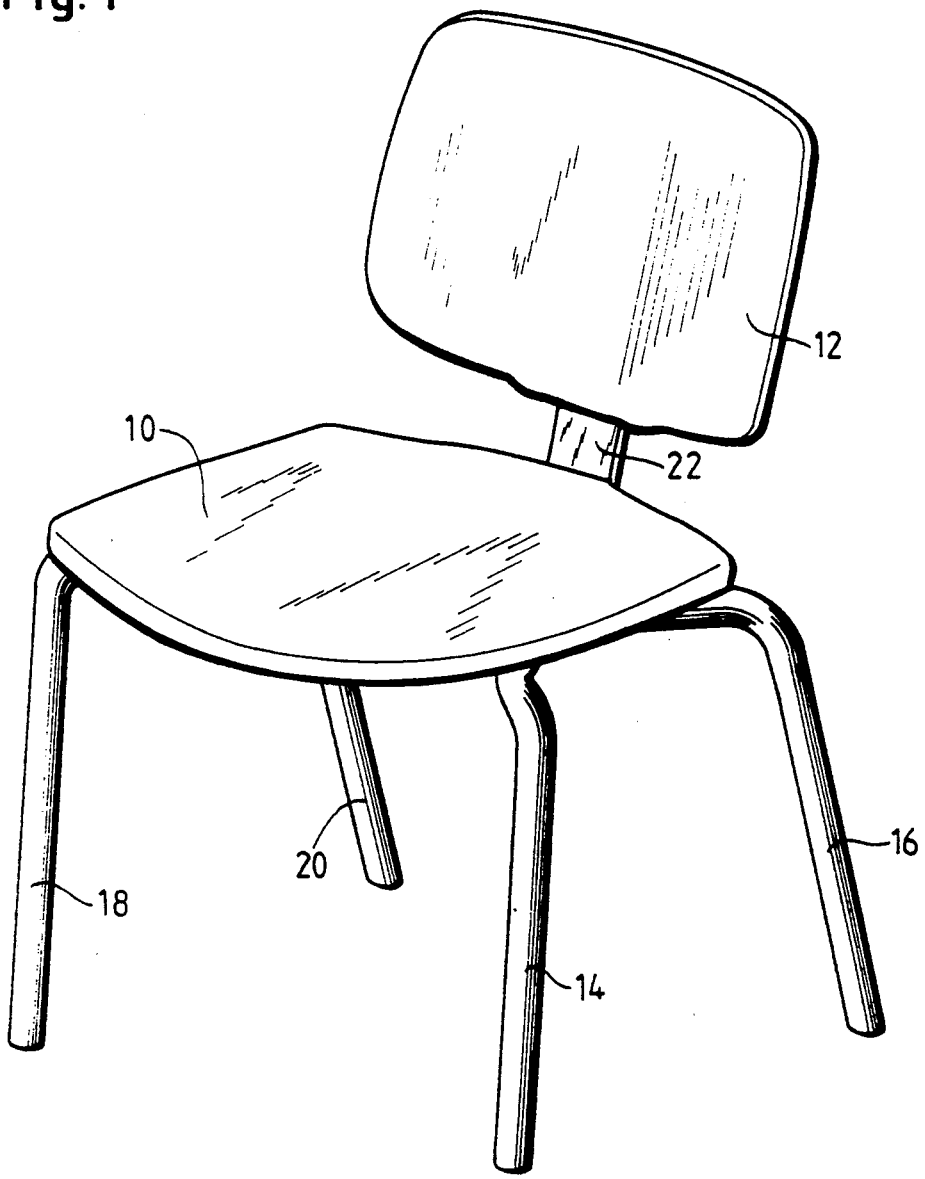
FIG. 1 is a perspective general representation of the chair according to the invention.

The chair shown in FIG. 1 comprises a seating plate 10 and a backrest 12. The chair also comprises front and rear legs 14 and 16 (which are in the present connection also defined as the left leg pair) and right front and rear legs 18 and 20 (the right leg pair).

Figure 2:
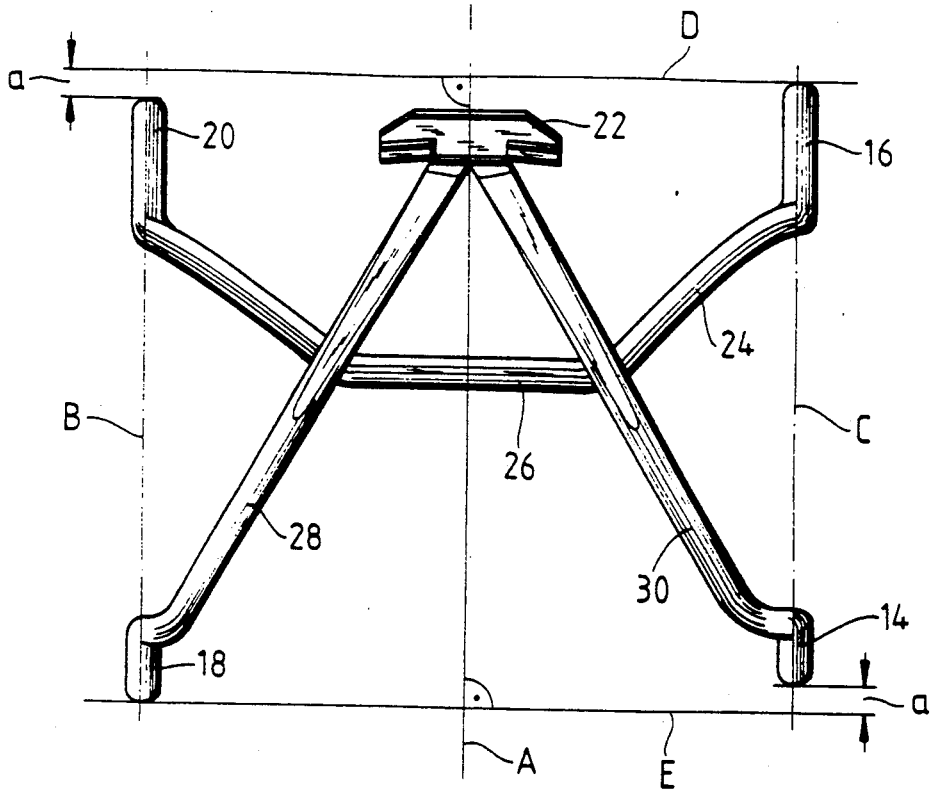
FIG. 2 is a plane view of the frame of the chair.
Figure 3:
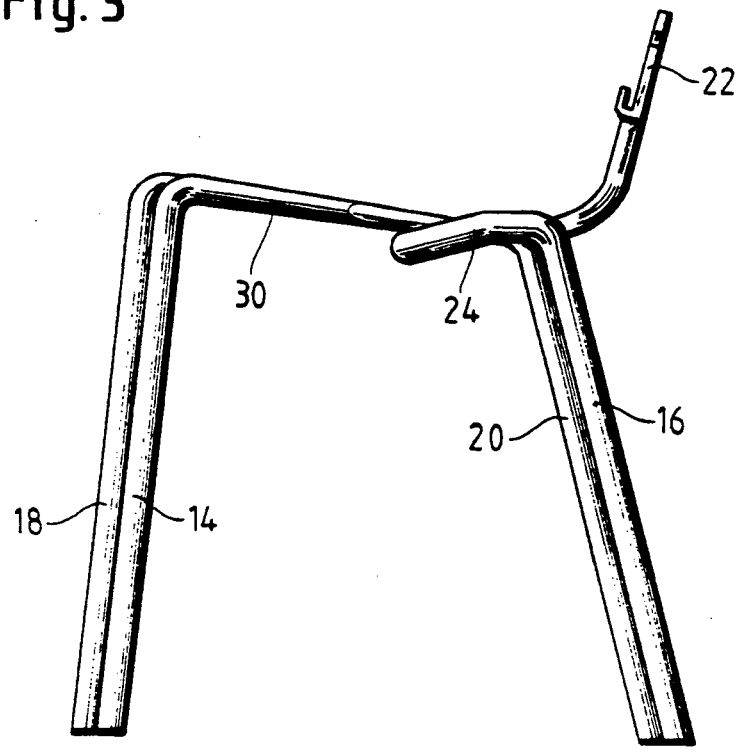
FIG. 3 shows an elevation of the frame.

FIG. 2 shows a plane view of the frame of the chair without the seating plate and backrest. FIG. 3 shows the corresponding elevation, and it will be seen from FIG. 3 that the leg pairs are obliquely diverging downwards, that is, the front legs 14 and 18 are directed obliquely to the front and the rear legs 16 and 20 are directed obliquely to the rear. According to FIG. 3, the rear legs form a greater angle relative to the normal than the front legs.

Apart from the frame, FIG. 2 shows several auxiliary lines, illustrating the geometry of the chair. Firstly, A designates the longitudinal center line of the seating plate, that is, the forward-backward direction of a person sitting on the chair. Lines B and C run parallel to line A on both sides and respectively designate the planes of the lateral leg pairs 18, 20 and 14, 16. In this connection, from FIG. 2 it will be apparent that the legs of both leg pairs stand directly one before the other or one behind the other, thus defining vertical planes on both sides of the chair.

Further, in FIG. 2 two lines D and E are shown running perpendicularly relatively to lines A, B and C, and thus extending horizontally transversely with respect to the seating direction. Lines D and E directly show that the legs 14 and 16 of the—for the user of the chair—left leg pair of FIG. 2 are offset to the rear or the top as compared with the legs 18 and 20 of the right leg pair. This offsetting a is about one leg thickness. As a result, laterally adjacent chairs can be joined such that the adjacent leg pairs are in one plane. In most cases from this follows a close compound arrangement in the lateral direction.

According to FIGS. 2 and 3 the front legs 14 and 18 run obliquely below the seating plate to the rear and to the middle or the longitudinal center line A of the seating plate. Here they are connected, for example, welded, to form a holder 22 which rises up. The holder 22 accommodates the backrest 12. On the other hand, according to FIG. 2, the rear legs 16 and 20 are part of a continuous, generally U-shaped shackle 24 which is arched below the seating plate to the front (that is, down in FIG. 2) the center section 26 the shackle 24 crosses both extensions—designated by 28 and 30—of the front legs 14 and 18 obliquely running below the seating plate to the rear and to the center.

In this manner the shackle 24 or the center section 26 thereof together with the extensions 28 and 30 of the front legs 14 and 18 forms a triangle, which is statically very stable. In particular, this triangular compound arrangement is significantly more stable than the common, T-shaped connections between legs and connecting rods connecting the legs. At the same time, the holder 22 for the backrest, starting from the rear top of the triangle, is directly connected to the frame of the chair.

The legs, the extensions thereof and the shackles may be made of tube material which is flatly compressed in the area of the crossing points between the extensions 28 and 30 of the front legs and the rear shackle 24 in order, to form relatively large contact areas behind the crossing points.

The drawing does not show armrests, which may be fixed to the front or rear legs, if necessary, or connecting elements for laterally connecting a line of chairs, since these parts may be made in the usual manner.

What I claim is:

1. An improved stackable line chair with four legs which stand on the floor and which support a seating plate, the legs being arranged in pairs in respective planes on both sides of the chair and diverging obliquely downwards, wherein the improvement comprises:

the legs (14, 16, 18, 20) on one side of the chair are offset as compared with the legs on the other side by one leg thickness relative to the seating plate (10); and the distance between said legs on one side of the chair is the same as the distance between said legs on the other side.

2. An improved line chair according to claim 1, wherein each front leg is part of a respective elongated member which additionally has a rear end portion and an intermediate portion (28, 30) that runs obliquely below the seating plate, and wherein the chair further comprises a holder (22) for a backrest (12), the holder rising behind the seating plate and being connected to the rear end portions of the elongated members.

3. An improved line chair according to claim 2, wherein the chair has a front side, and wherein the rear legs (16,20) are part of a continuous shackle (24) which additionally has an arched portion that is disposed below the seating plate (10), the arched portion protruding toward the front side of the chair and being connected to the intermediate portions (28, 30) of the elongated members at respective crossing points, the intermediate portions of the elongated members and the arched portion of the shackle having respective segments that form a triangle.

4. An improved line chair according to claim 3, wherein the elongated members and the shackle consist of tube material that is flattened at the crossing points between the shackle (24) and the intermediate portions (28, 30) of the elongated members.

5. A chair comprising a seating plate;

a holder;

a backrest mounted on the holder; and a frame on which the seating plate and the holder are mounted, the frame including a tubular shackle having a left back leg portion, a right back leg portion, and an arched portion between the back leg portions, a left tubular member having a left front leg portion, an intermediate portion that is connected to the arched portion of the shackle, and a rear end portion that is connected to the holder, and a right tubular member having a right front leg portion, an intermediate portion that is connected to the arched portion of the shackle, and a rear end portion that is connected to the holder, wherein the distance between the left leg portions is the same as the distance between the right leg portions, but the left leg portions are offset by the width of a leg portion with respect to the right leg portions in such a manner that the distance between the left front leg portion and the right rear leg portion is different from the distance between the right front leg portion and the left rear leg portion.

6. The chair of claim 5, wherein the arched portion of the shackle has a straight segment when seen from above the frame and wherein the intermediate portions of the tubular members have respective straight segments when seen from above the frame, the straight segments forming a triangle.

7. The chair of claim 6, wherein the intermediate portions of the tubular members cross the arched portion of the shackle at crossing points, the intermediate portions and the arched portion being flattened at the crossing points.

8. The chair of claim 5, wherein the left tubular member has a sharp bend between the left front leg portion and the intermediate portion, wherein the right tubular member has a sharp bend between the right front leg portion and the intermediate portion, and wherein the intermediate portions of the left and right tubular members slope downward from the bends.

* * * * *